US010513042B2

(12) United States Patent
Coffland et al.

(10) Patent No.: US 10,513,042 B2
(45) Date of Patent: Dec. 24, 2019

(54) CUTTING METHODS

(71) Applicant: The Boeing Company, Chicago, IL (US)

(72) Inventors: Donald Wayne Coffland, Seattle, WA (US); Christine Mary Anderson, Edmonds, WA (US); Curtis Lynn Backman, Seattle, WA (US); Aaron R. Ayers, Granite Falls, WA (US); David Scott Wright, Snohomish, WA (US); Scott Edward Shapiro, Mill Creek, WA (US); Donald R. Young, Tulalip, WA (US)

(73) Assignee: THE BOEING COMPANY, Chicago, IL (US)

( * ) Notice: Subject to any disclaimer, the term of this patent is extended or adjusted under 35 U.S.C. 154(b) by 181 days.

(21) Appl. No.: 15/348,328

(22) Filed: Nov. 10, 2016

(65) Prior Publication Data

US 2017/0057107 A1 Mar. 2, 2017

Related U.S. Application Data

(62) Division of application No. 14/059,604, filed on Oct. 22, 2013, now Pat. No. 9,492,934.

(51) Int. Cl.
*B26B 25/00* (2006.01)
*B65B 69/00* (2006.01)
(Continued)

(52) U.S. Cl.
CPC ..... *B26B 27/00* (2013.01); *B26B 25/005* (2013.01); *B26B 29/06* (2013.01); *B26D 7/0006* (2013.01); *B65B 69/0025* (2013.01)

(58) Field of Classification Search
CPC ..... B29B 29/00; A45D 29/18; B26B 27/00; B26B 29/06; B26B 25/005; B26B 29/00; B26D 7/0006; B65B 69/0025
(Continued)

(56) References Cited

U.S. PATENT DOCUMENTS 2,599,439 A * 6/1952 Drake ..... B26B 5/006 30/151
3,590,483 A * 7/1971 Szczepanski ..... B26B 5/00 30/151
(Continued)

FOREIGN PATENT DOCUMENTS

CN 86102079 A 11/1986
CN 2032930 U 2/1989
(Continued)

OTHER PUBLICATIONS

Chinese Office Action dated Jun. 20, 2017 in corresponding Chinese Application No. 201410569324.7, 10 pages.
(Continued)

*Primary Examiner* — Jason Daniel Prone
*Assistant Examiner* — Samuel A Davies
(74) *Attorney, Agent, or Firm* — MH2 Technology Law Group LLP

(57) ABSTRACT

A tool for cutting a tie wrap bound about a wire bundle. The tool includes a body portion having a generally disc-shaped cutter and cutting edge. A shield covers one side of the cutter and defines first and second shield slots in communication with the cutting edge. A housing pivotally connected to the body portion covers the other side of the cutter and defines first and second housing slots that communicate with the cutting edge. The housing pivots between first, second, and third positions. In the first position, the first housing slot communicates with the first shield slot to expose the cutting
(Continued)

edge for cutting purposes. In the second position, the first housing slot is out of communication with the first shield slot, thereby covering the cutting edge. And, in the third position, the second housing slot communicates with the second shield slot to expose the cutting edge.

20 Claims, 16 Drawing Sheets

(51) Int. Cl.
*B26B 29/06* (2006.01)
*B26B 27/00* (2006.01)
*B26D 7/00* (2006.01)

(58) Field of Classification Search
USPC ..... 30/286, 290
See application file for complete search history.

(56) References Cited

U.S. PATENT DOCUMENTS

| | | | | |
|---|---|---|---|---|
| 6,094,824 | A | 8/2000 | Takeshita | |
| 6,327,783 | B1 | 12/2001 | Ming | |
| 7,073,263 | B2 | 7/2006 | Kawasaki | |
| 2006/0150426 | A1* | 7/2006 | Okada | B26B 29/06 30/287 |
| 2010/0206148 | A1* | 8/2010 | Reyes | B26B 27/00 83/53 |
| 2013/0139392 | A1 | 6/2013 | Wright | |
| 2013/0139661 | A1 | 6/2013 | Wright | |

FOREIGN PATENT DOCUMENTS

| | | | |
|---|---|---|---|
| CN | 201120622 | Y | 9/2008 |
| CN | 101489742 | A | 7/2009 |
| JP | S35-026459 | Y | 10/1935 |
| JP | S46-023040 | Y | 8/1971 |
| JP | H06-024679 | U | 4/1994 |
| JP | H08-280947 | A | 10/1996 |
| JP | 3051516 | U | 8/1998 |
| JP | 2002-028385 | A | 1/2002 |
| JP | 2005-124711 | A | 5/2005 |

OTHER PUBLICATIONS

Communication dated Mar. 23, 2015 regarding Application No. EP 14181939.

Partial European Search Report for Application No. EP 14 181929 dated Mar. 12, 2015.

Communication from the Canadian Intellectual Property Office dated Oct. 28, 2015 regarding Canadian Patent Application No. 2,862,852.

Communication from European Patent Office dated Jan. 1, 2017 regarding European Patent Application No. 14 181 929.2.

Webpage,http://www.dickblick.com/products/carl-rotary-handheld-cutter/, Carl Rotary Handheld Cutter.

Webpage, CC=10 Handheld Rotary Trimmer Craft Combo Kit.

Kameda (Japanese Patent Examiner), Notice of Reasons of Rejections dated Aug. 3, 2018 in corresponding Japanese Patent Application No. 2014-214259 (English translation) 4 pages.

* cited by examiner

CUTTING METHODS

The present application is a divisional application of U.S. patent application Ser. No. 14/059,604 ("the '604 application"), filed on Oct. 22, 2013, in the U.S. Patent and Trademark Office ("USPTO"), and issued as U.S. Pat. No. 9,492,934 B2 on Nov. 15, 2016. The '604 application was a continuation-in-part of U.S. patent application Ser. No. 13/312,252 ("the '252 application"), filed on Dec. 6, 2011, in the USPTO, and issued as U.S. Pat. No. 10,118,305 B2 on Nov. 6, 2018. The entire contents of the '604 application and the '252 application are incorporated herein by reference.

BACKGROUND

The present disclosure relates generally to a cutting tool, and more specifically, to methods and systems for cutting fasteners.

Fasteners such as tie wraps, also known as "zip ties," are commonly used for a variety of purposes in industrial settings. For example, such tie wraps are commonly used to secure electrical wires in bundles. It is common, particularly in routing electrical wires, to use tie wraps to bind bundles of wires together. The binding of wire bundles allows similar groupings of wires to be grouped together to facilitate installation of the wires. Further, tie wraps prevent elongated wires from tangling and enables better wire management.

Known tie wraps include an elongated portion having a securing mechanism integral therewith. A distal end of the tie wrap is passed through an opening in the securing mechanism. The securing mechanism contains a tab that engages teeth spaced along the length of the elongated portion. The tab engages successive teeth as the elongated portion is pulled through the securing mechanism. Moreover, the tab acts as a ratchet to effectively prevent the elongated portion from being removed after it is installed.

Tie wraps are sometimes removed after installation of the wire bundles and/or during later maintenance operations. Typically, personnel use conventional wire cutters, razor knives, or similar cutting tools to remove the tie wraps. During removal of the tie wraps, insulation covering one of the wires may be moderately nicked or cut with the cutting tool. Damaged insulation may require repair or require the wire and/or the bundle of wires to be replaced, this damage leads to costly and/or time-consuming outages or delays. Further, in some instances, conventional cutting tools have exposed blades that may result in minor injuries that require attention and that ultimately may result in further delay.

SUMMARY

It would be desirable to provide a method and apparatus that address at least some of the issues discussed above, as well as other potential issues. Moreover, it would be beneficial to furnish a method and tool for cutting wire ties on wire bundles without damaging wires in the wire bundle and without injuring the tool's user.

Examples of the present disclosure are generally directed to a cutting tool and method for use in cutting a tie wrap that is bound about at least one wire. Generally, an example implementation includes a tool for use in cutting a tie wrap bound about at least one wire. The tool may comprise a body portion having an end and a second portion spaced from the end, and a cutter connected to the second portion having a cutting edge configured to cut a tie wrap. The second portion defines a second portion slot that communicates with the cutting edge having a mouth and a floor portion generally opposite the mouth. The mouth is of a first width and the floor portion is of a second width, with the second width being greater than the first width. A wall portion extends at a generally acute angle with respect to the floor portion from proximate the mouth to proximate the floor portion.

In another example implementation, tool is provided for use in cutting a tie wrap bound about at least one wire, with the tool comprising a body portion having an end and a second portion spaced from the end. A cutter is connected to the second portion and has a cutting edge configured to cut a tie wrap. The cutter is adapted to rotate about an axis of rotation and has a first side and a second side generally opposite the first side. The second portion includes a generally ring-shaped first projection generally coaxial with respect to the axis of rotation and being of a first diameter. A generally semi-circular-shaped second projection is generally coaxial with respect to the axis of rotation and is of a second diameter, which is greater than the first diameter. The second projection is in general contact with the first side of the cutter and is configured to act as a bearing surface that facilitates rotation of the cutter with respect to the second portion.

In another example implementation, a tool is provided for use in cutting a tie wrap bound about at least one wire is provided. The tool includes a body portion having an end and a second portion spaced from the end. A generally disc-shaped cutter is rotatably connected to the second portion. The cutter defines a first side and a second side generally opposite the first side and a generally circumferentially-extending cutting edge. The second portion also has a shield that covers a substantial portion of the first side of the cutter, and the shield defines a first shield slot and a second shield slot that each communicate with the first side of the cutter and the cutting edge. A housing is pivotally connected to the body portion and covers a substantial portion of the second side of the cutter. The housing defines a first housing slot and a second housing slot that each communicate with the second side and the cutting edge of the cutter. The housing is configured to pivot to selectively substantially expose one of the first or second portions of the cutting edge for use in cutting a tie wrap while the other of the first or second portions of the cutting edge is substantially covered by the shield.

In another example, the housing is configured to pivot to a first position, wherein the first housing slot is generally in communication with the first shield slot, and a first portion of the cutting edge is exposed for use in cutting a tie wrap.

In another example, the housing is also configured to pivot to a second position, wherein the first housing slot is generally out of communication with the first shield slot, and the first portion of the cutting edge is substantially covered.

In another example, the housing is configured to pivot to a third position, wherein the second housing slot is generally in communication with the second shield slot, and a second portion of the cutting edge is exposed for use in cutting a tie wrap.

In another example implementation, the tool further comprises a handle defining a handle cavity, and the first end of the body portion of the tool being pivotally connected to the handle for movement relative thereto between a retracted position substantially within the handle cavity and an extended position extending generally outwardly from the handle cavity.

In another example implementation, the body portion defines a first recess, a second recess, and a third recess. A locking member is connected to the housing: that engages the first recess upon the housing being in the first position to releasably lock the housing in the first position relative to the body portion; that engages the second recess upon the housing being in the second position to releasably lock the housing in the second position relative to the body portion; and that engages the third recess upon the housing being in the third position to releasably lock the housing in the third position relative to the body portion.

In another example implementation, the shield of the tool has an axis of rotation about which the cutter rotates and a generally ring-shaped first projection generally coaxial with respect to the axis of rotation and being of a first diameter. Also provided is a generally ring-shaped second projection generally coaxial with respect to the axis of rotation and being of a second diameter greater than the first diameter. The first projection and the second projection are in contact with the first side of the cutter and are configured to act as bearing surfaces that facilitate rotation of the cutter with respect to the shield.

In another example implementation, at least one of the first housing slot, the second housing slot, the first shield slot, and the second shield slot has a mouth and a floor portion generally opposite the mouth (the mouth being of a first width and the floor portion being of a second width), and the second width is greater than the first width. Also, a wall portion extends at a generally acute angle with respect to the floor portion from proximate the mouth to proximate the floor portion.

In another example implementation, a tool for use in cutting a tie wrap bound about at least one wire is also provided. The tool comprises a handle defining a handle cavity, and at least one arm is provided having a first portion connected to the handle for movement of the arm relative to the handle. The arm is movable between a retracted position substantially within the handle cavity and an extended position extending generally outwardly from the handle cavity. The arm has a second portion spaced from the first portion and a cutter connected to the second portion. The cutter defines a first side and a second side generally opposite the first side and a generally arcuate cutting edge. Additionally, the second portion has a shield that covers a substantial portion of the first side of the cutter, and the shield defines a first shield slot and a second shield slot that each communicates with the cutting edge and the first side of the cutter. A housing is pivotally connected to the arm and covers a substantial portion of the second side of the cutter. The housing defines a first housing slot and a second housing slot that each communicates with the cutting edge and the second side of the cutter. The housing is pivotable to a first position, wherein the first housing slot is generally in communication with the first shield slot, and a first portion of the cutting edge is exposed for use in cutting a tie wrap. The housing is also pivotable to a second position, wherein the first housing slot is generally out of communication with the first shield slot, and the first portion of the cutting edge is substantially covered. Also, the housing is pivotable to a third position, wherein the second housing slot is generally in communication with the second shield slot, and a second portion of the cutting edge is exposed for use in cutting a tie wrap.

In another example implementation, a second arm is connected to the handle, and includes a cutter defining a first side and a second side, generally opposite the first side, and an arcuate cutting edge. A second portion of the second arm has a shield that covers a substantial portion of the first side of the cutter, and the shield of the second arm defines at least one shield slot that exposes a portion of the cutting edge. A housing is pivotally connected to the second arm and covers a substantial portion of the second side of the cutter. The housing of the second arm defines a housing slot that communicates with the second side of the of the cutter and the cutting edge, and the housing of the second arm is pivotable to a first position, wherein the housing slot is generally in communication with the shield slot, and the portion of the cutting edge is exposed for use in cutting a tie wrap. Also, the housing is pivotable to a second position, wherein the housing slot is generally out of communication with the shield slot, and the portion of the cutting edge is substantially covered.

In another example, means are provided for moving the wire out of the vicinity of the exposed one of the first or second portions of the cutting edge prior to use of the exposed one of the first and second portions of the cutting edge in cutting a tie wrap.

In another example, the housing defines a radially extending recess in communication with at least one of the first and second housing slots that receives the wire tie during cutting.

In another example implementation, a method of operating a cutting tool for cutting a tie wrap bound about a plurality of wires is provided. The method comprises: providing an elongated body member having a cutter with a generally arcuate cutting edge, the cutter being rotatably connected to the body member, and a shield connected to the body member that substantially covers a first side of the cutter, the shield defining at least one shield slot that communicates with the cutting edge of the cutter, and providing a housing pivotally connected to the body member that covers a substantial portion of the second side of the cutter, the housing defining at least one slot that communicates with the cutting edge of the cutter. The method further comprises moving the housing to a first position, wherein the housing slot is generally out of communication with the shield slot and the portion of the cutting edge is substantially covered, and moving the housing to a second position, wherein the housing slot is generally in communication with the shield slot and the portion of the cutting edge is exposed for use in cutting a tie wrap.

The method may also include aligning the body member to be generally parallel to the wires and moving the wire out of the vicinity of the cutting edge and forcing the cutting edge against the tie wrap to at least partially cut the tie wrap without cutting the wire.

In a further variation, an exemplary implementation of a method may include providing at least one of a first housing slot, a second housing slot, a first shield slot, and a second shield slot having a mouth and a floor portion generally opposite the mouth; the mouth being of a first width, and the floor portion being of a second width, and the second width being greater than the first width, with the wall portion extends at a generally acute angle with respect to the floor portion from proximate the mouth to proximate the floor portion. The body member may be moved using a motion generally parallel to the at least one wire and the wall portion to engage the tie wrap with the wall portion, and then cutting the side portion of the tie wrap. The cut portion of the side portion of the tie wrap can then be slid towards the floor portion.

In another example implementation, a tool is provided for use in cutting a tie wrap bound about at least one wire, the tool having a body portion with an end and a second portion spaced horn the end and a cutter connected to the second portion. The cutter defines a first side and a second side generally opposite the first side and a cutting edge. The second portion of the body portion has a shield that covers a substantial portion of the first side of the cutter and shield defines at least one shield slot that communicates with the first side of the cutter and the cutting edge. A housing is connected to the body portion that covers a substantial portion of the second side of the cutter and defines at least one housing slot that communicates with the second side of the cutter, the shield slot, and the cutting edge of the cutter. Also, at least one of the housing slot and the shield slot has a mouth and a floor portion generally opposite the mouth, with the mouth being of a first width and the floor portion being of a second width. The second width is greater than the first width, and a wall portion extends at a generally acute angle with respect to the floor portion from proximate the mouth to proximate the floor portion.

In another example implementation, a method is disclosed of operating a cutting tool for cutting a tie wrap on at least one wire, including providing a body member having a cutter with a cutting edge (the cutter being rotatably connected to the body member) and a housing pivotally connected to the body portion that substantially covers a first side of the cutter and that defines a first housing slot and a second housing slot that each selectively expose the cutting edge. One of the first and second housing slots are selected to expose a first portion of the cutting edge, and the housing is pivoted such that selected one of the first and second housing slots exposes the first portion of the cutting edge while simultaneously causing a second portion of the cutting edge adjacent the non-selected one of the first and the second housing slots to be substantially covered. The wire is moved out of the vicinity of the cutting edge using a portion of at least one of the housing and the body member, and the first portion of the cutting edge is forced against the tie wrap to at least partially cut the tie wrap without cutting the wire. The providing of the body member may include providing a shield connected to the body member that substantially covers a second side of the cutter, with the shield defining a first shield slot that exposes the first portion of the cutting edge and a second shield slot that exposes the second portion of the cutting edge. The example method may also include (upon the pivoting of the housing such that the selected one of the first and second housing slots exposes the first portion of the cutting edge) the first shield slot communicating with the selected one the first and second housing slots. The example method may, in one implementation, include using the housing and the shield to cover substantially the entirety of portion of the cutting edge not otherwise exposed by the first housing slot and not covered by the second housing slot.

The features, functions and advantages discussed herein may be achieved independently in various examples or may be combined in yet other exemplary aspects of the disclosure, the further details of which may be seen with reference to the following description and drawings.

BRIEF DESCRIPTION OF THE DRAWINGS

Figure 1:
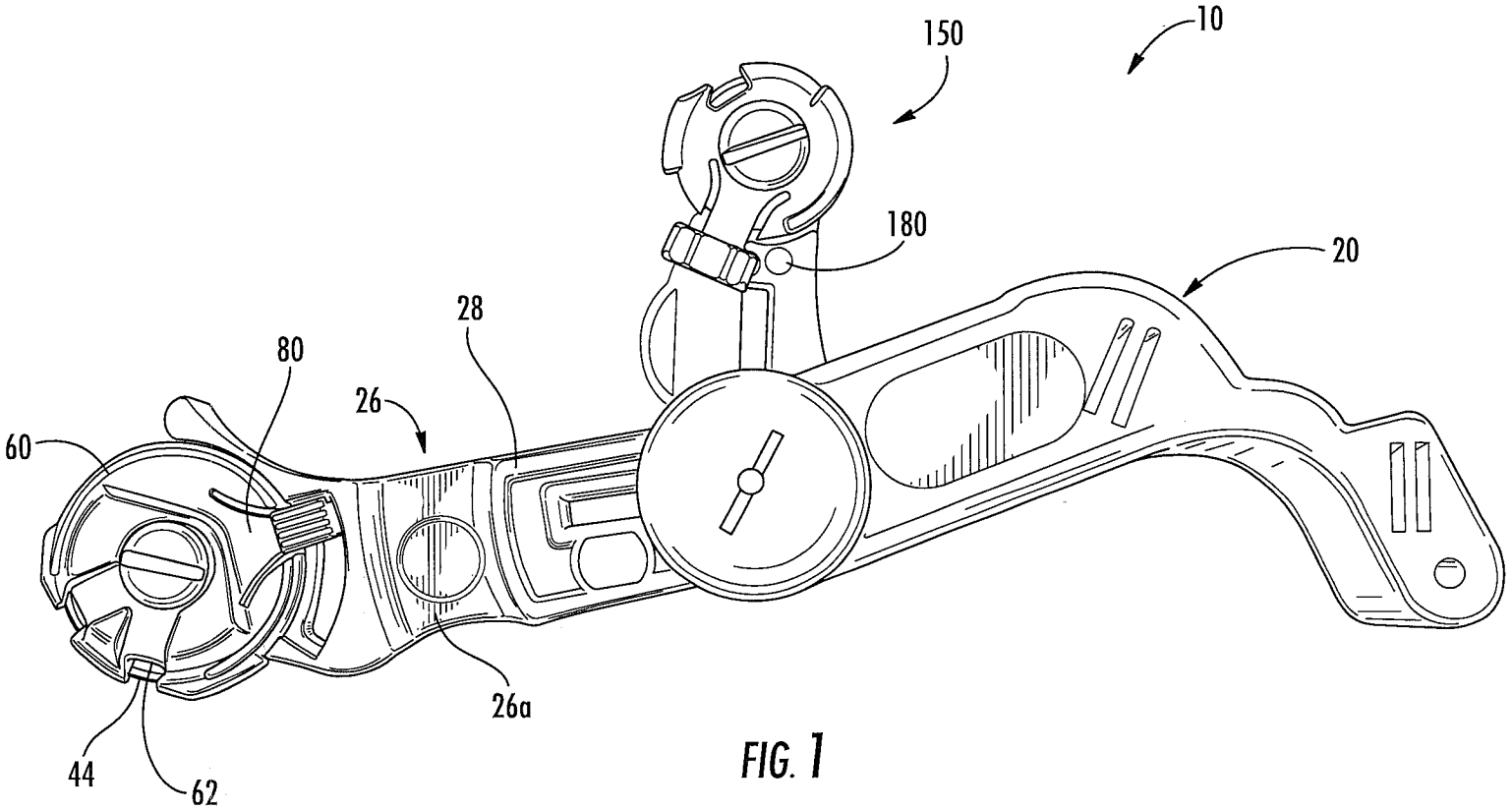

Having thus described exemplary aspects of the disclosure in general terms, reference will now be made to the accompanying drawings, which are not necessarily drawn to scale, and wherein:

FIG. 1 illustrates a perspective view of an exemplary cutting tool that may be used to cut a fastener.

Figure 2:
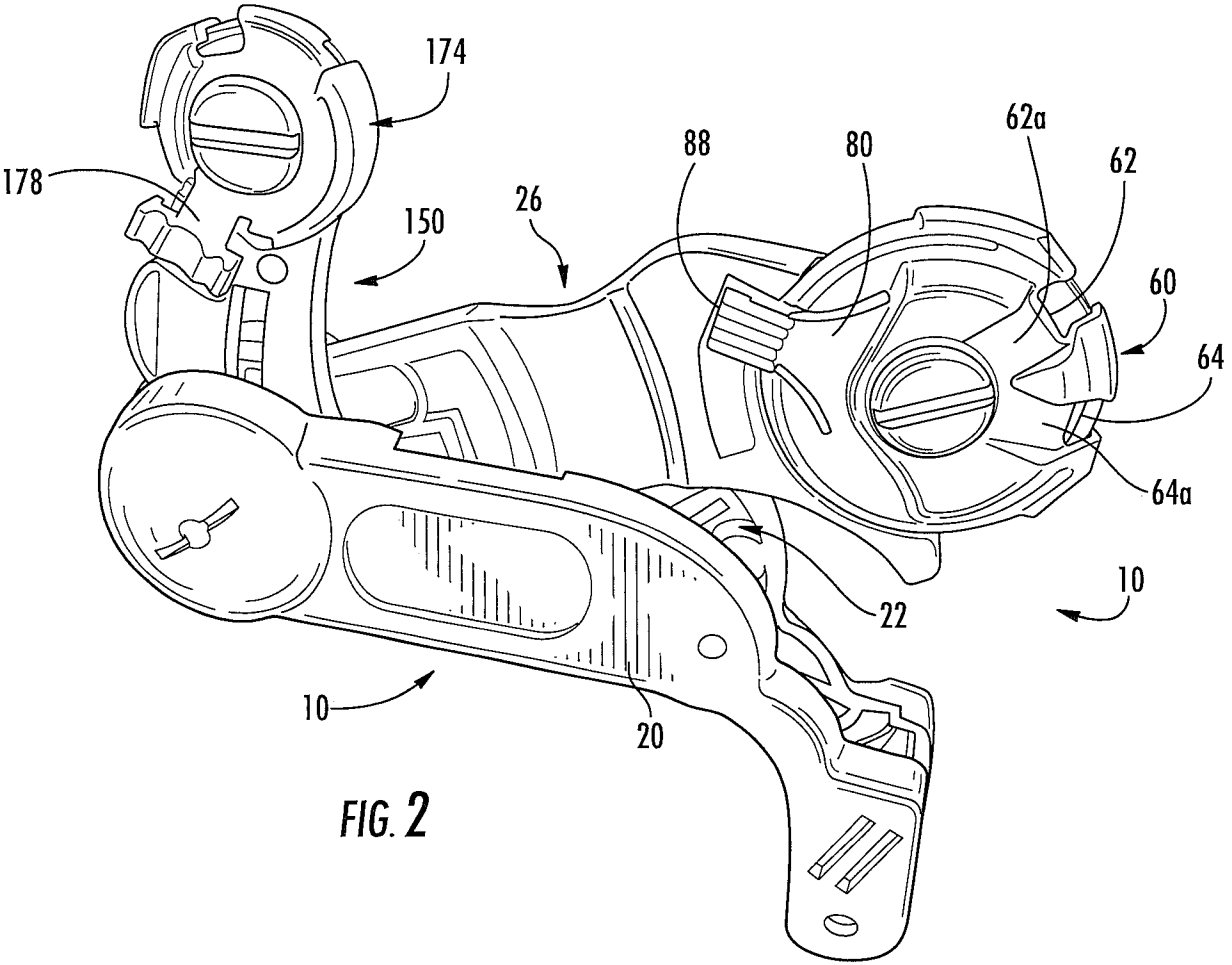

FIG. 2 illustrates a perspective view of the cutting tool shown in FIG. 1.

Figure 3A:
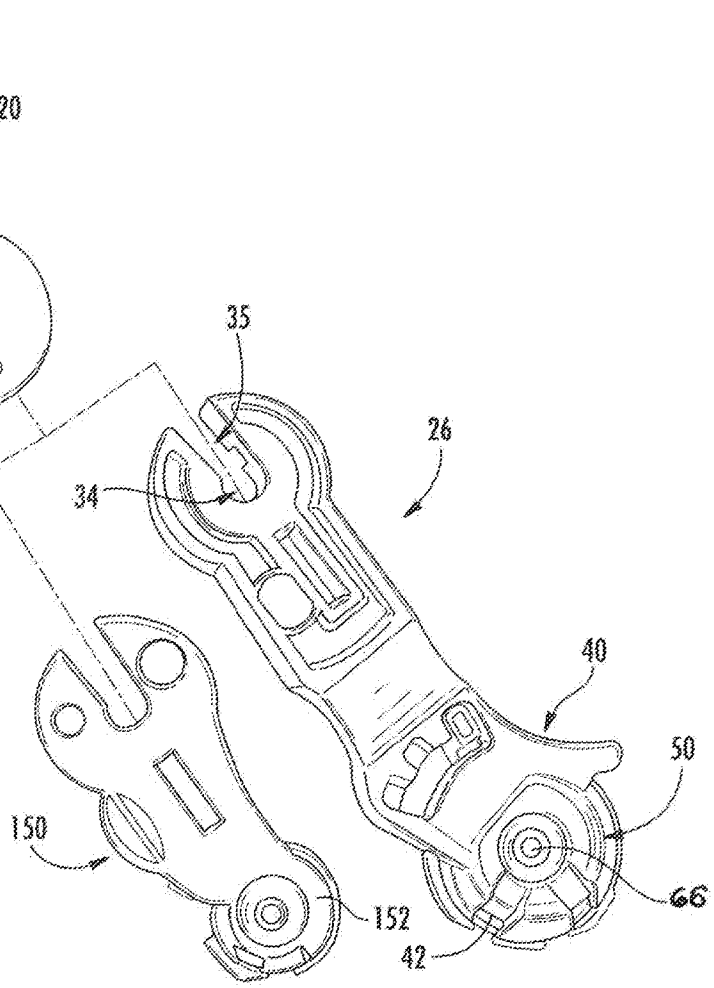
Figure 3B:
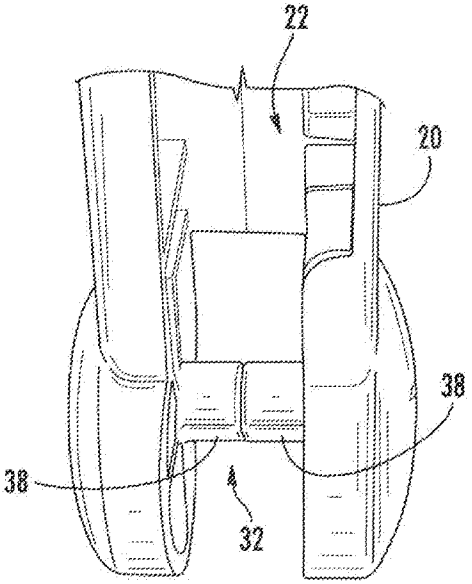

FIGS. 3A and 3B illustrate perspective, disassembled views of the cutting tool shown in FIG. 1.

Figure 4:
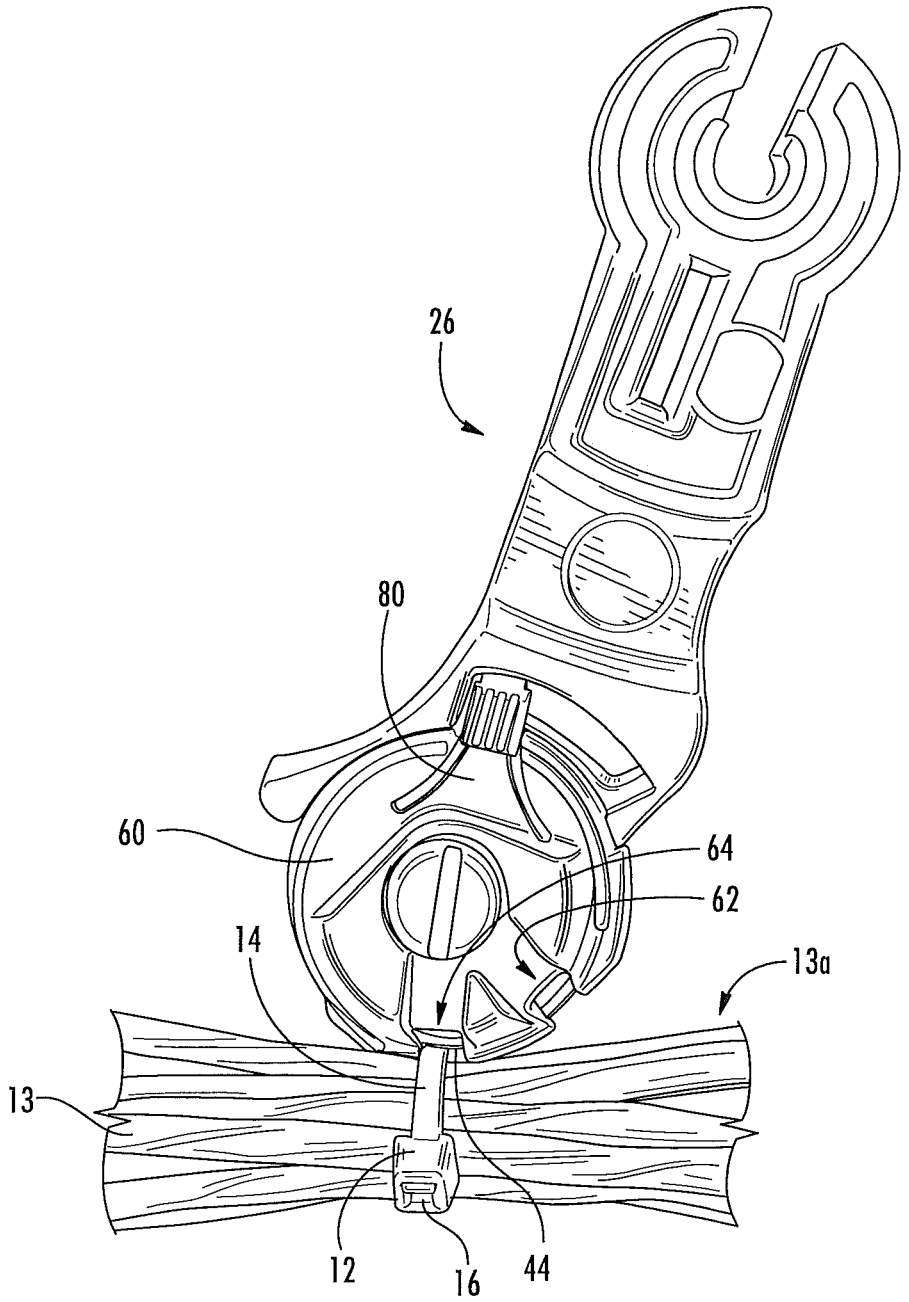

FIG. 4 illustrates a perspective view of a portion of the cutting tool shown in FIG. 1 and engaging a fastener.

Figure 5:
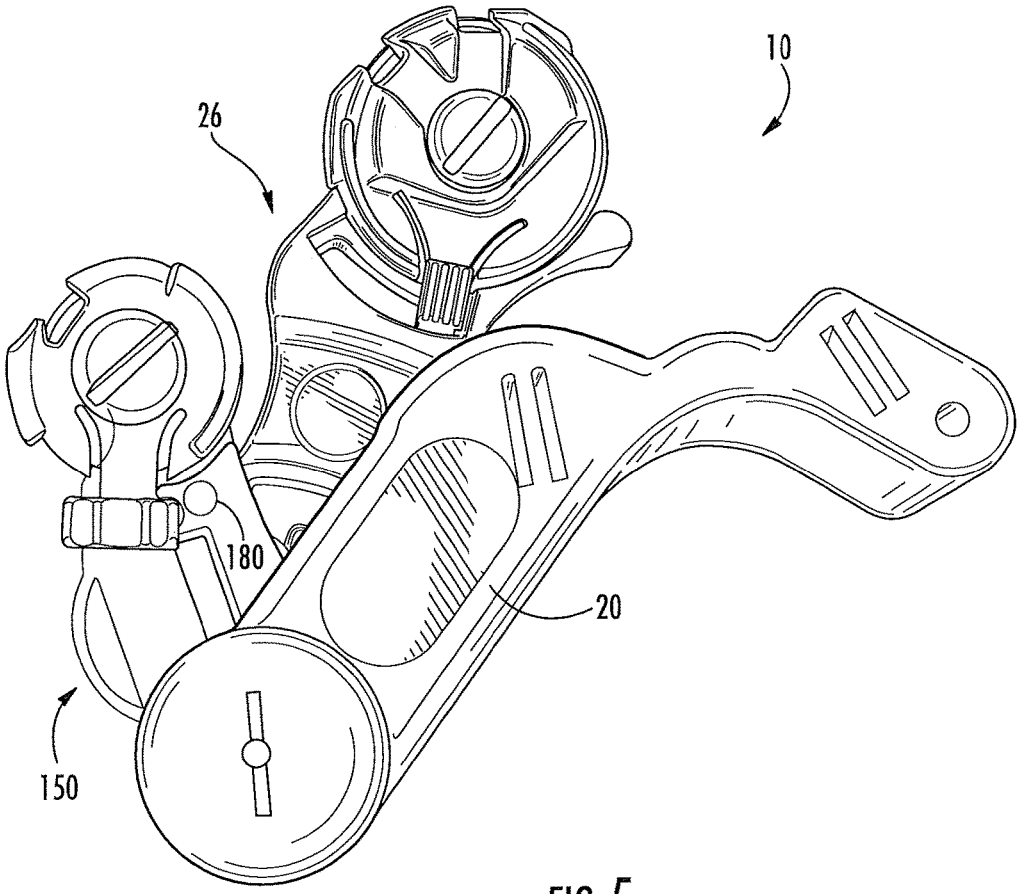

FIG. 5 illustrates a perspective view of the cutting tool shown in FIG. 1.

Figure 6:
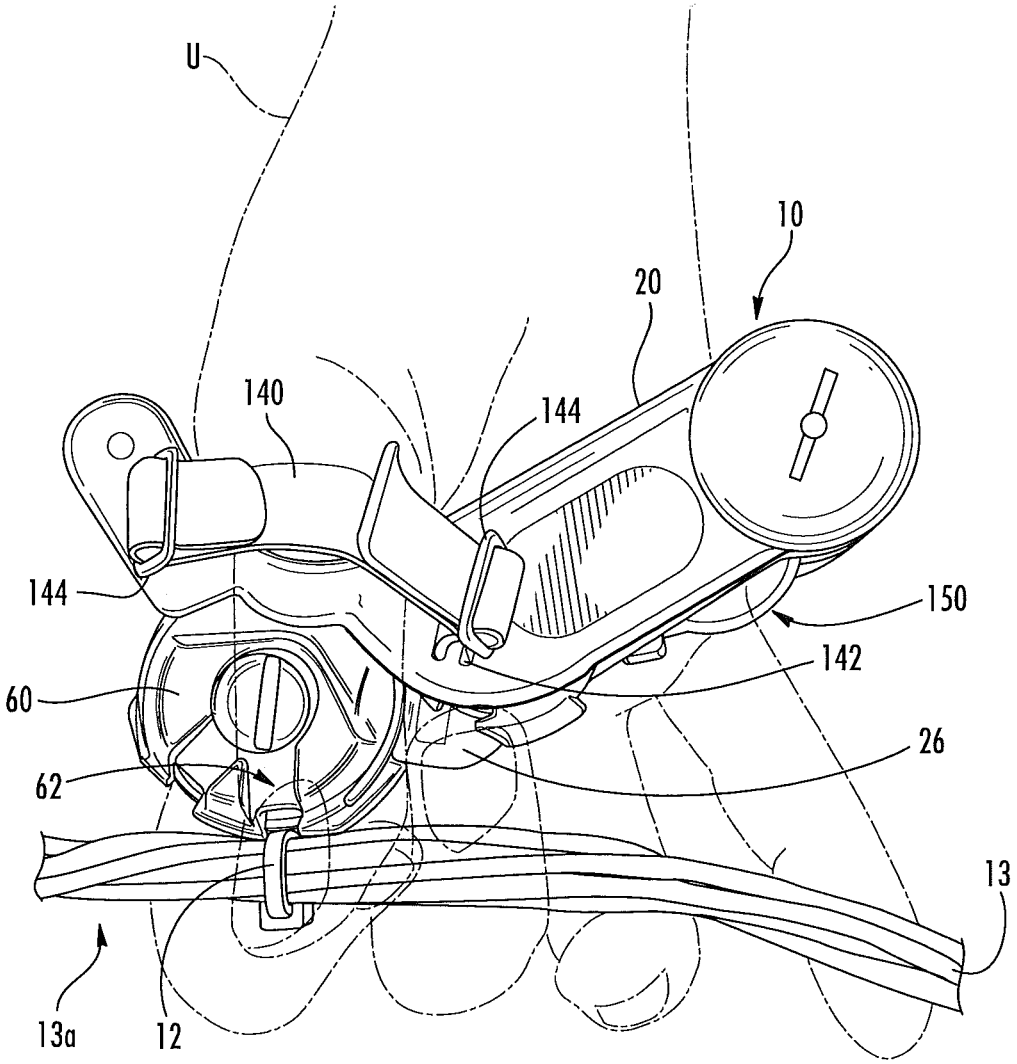

FIG. 6 illustrates a perspective view of the cutting tool shown in FIG. 1 being held by a user to engage a fastener.

Figure 7A:
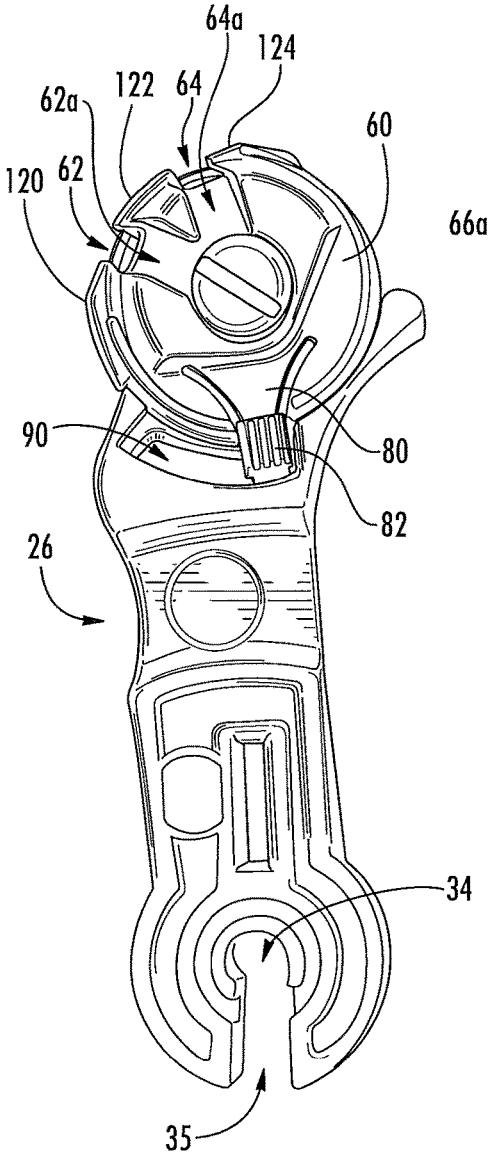
Figure 7B:
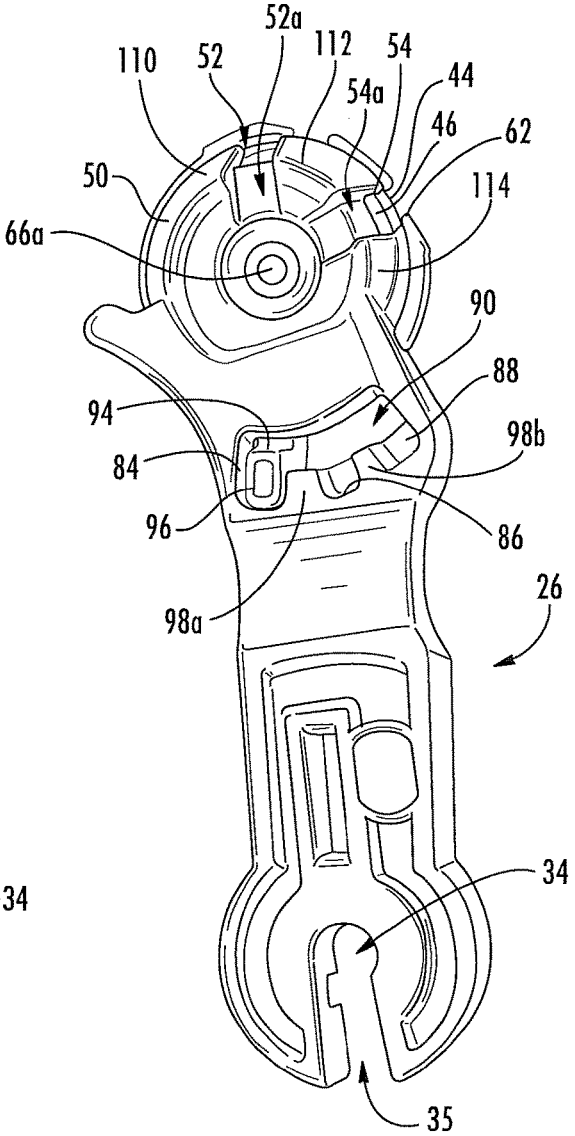

FIGS. 7A and 7B illustrate perspective views of a cutting member dissembled from the cutting tool shown in FIG. 1.

Figure 8A:
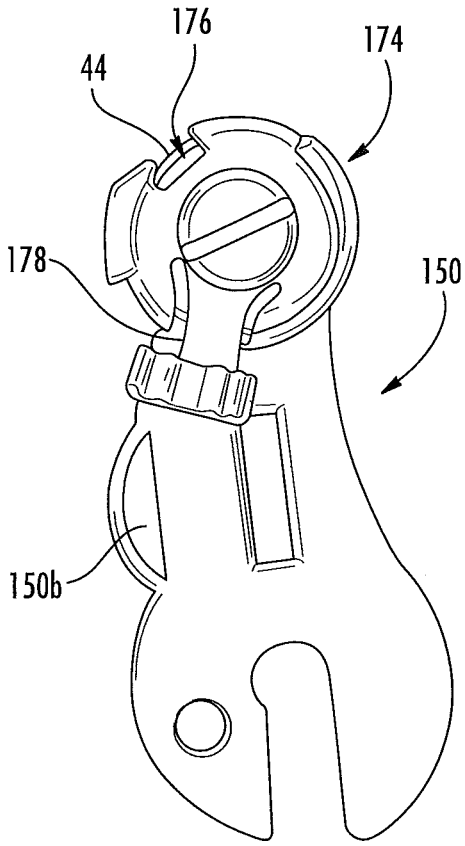
Figure 8B:
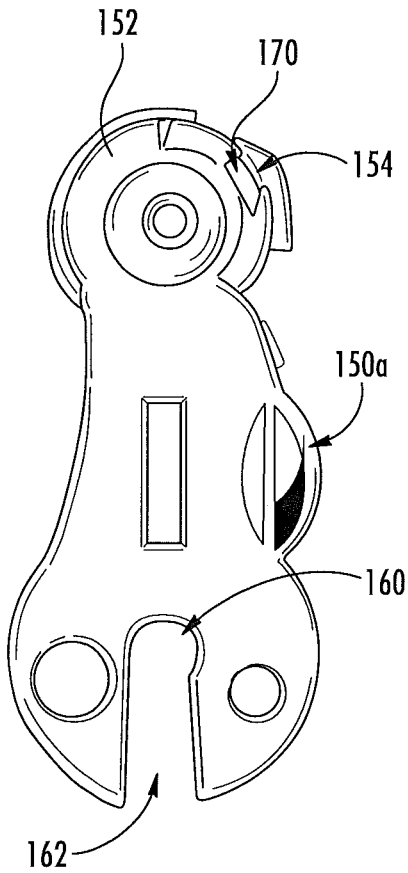

FIGS. 8A and 8B illustrate perspective views of a cutting member dissembled from the cutting tool shown in FIG. 1.

Figure 9:
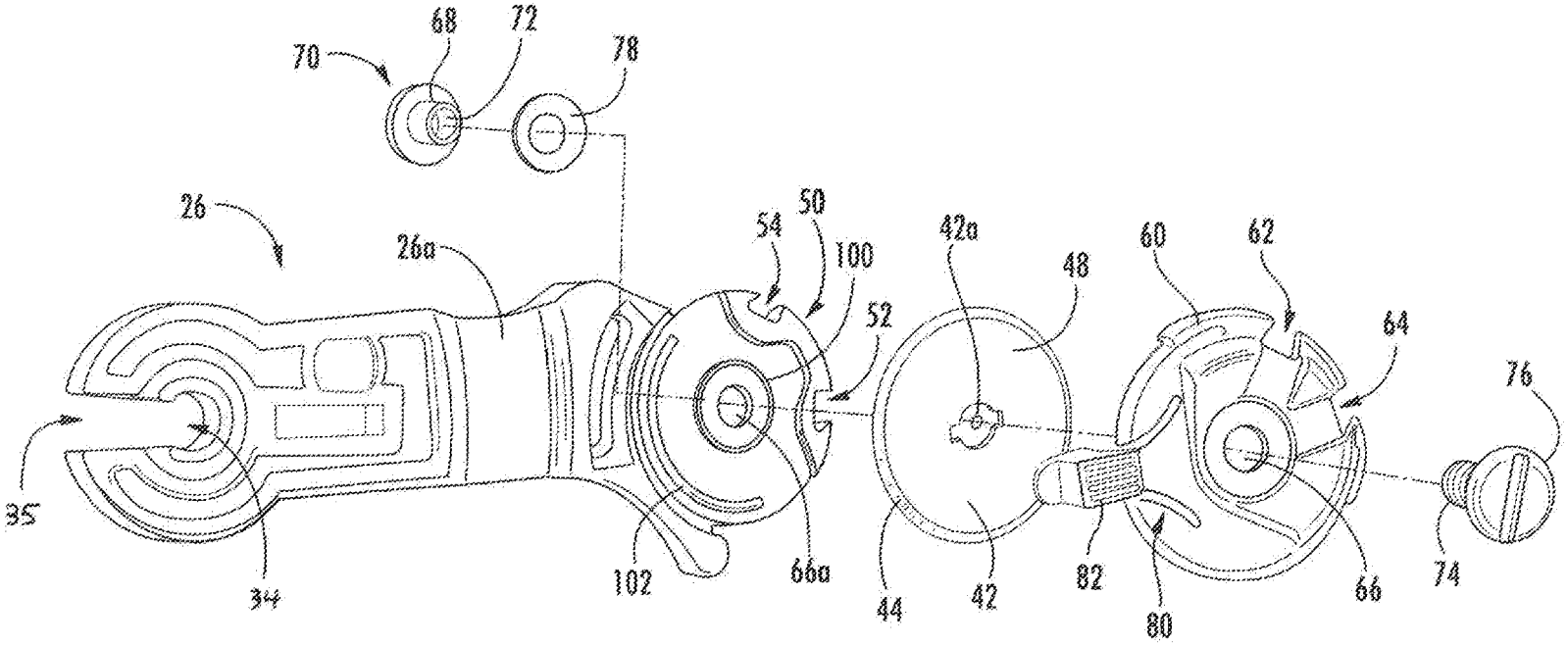

FIG. 9 illustrates an exploded view of a cutting member dissembled from the cutting tool shown in FIG. 1.

Figure 9A:
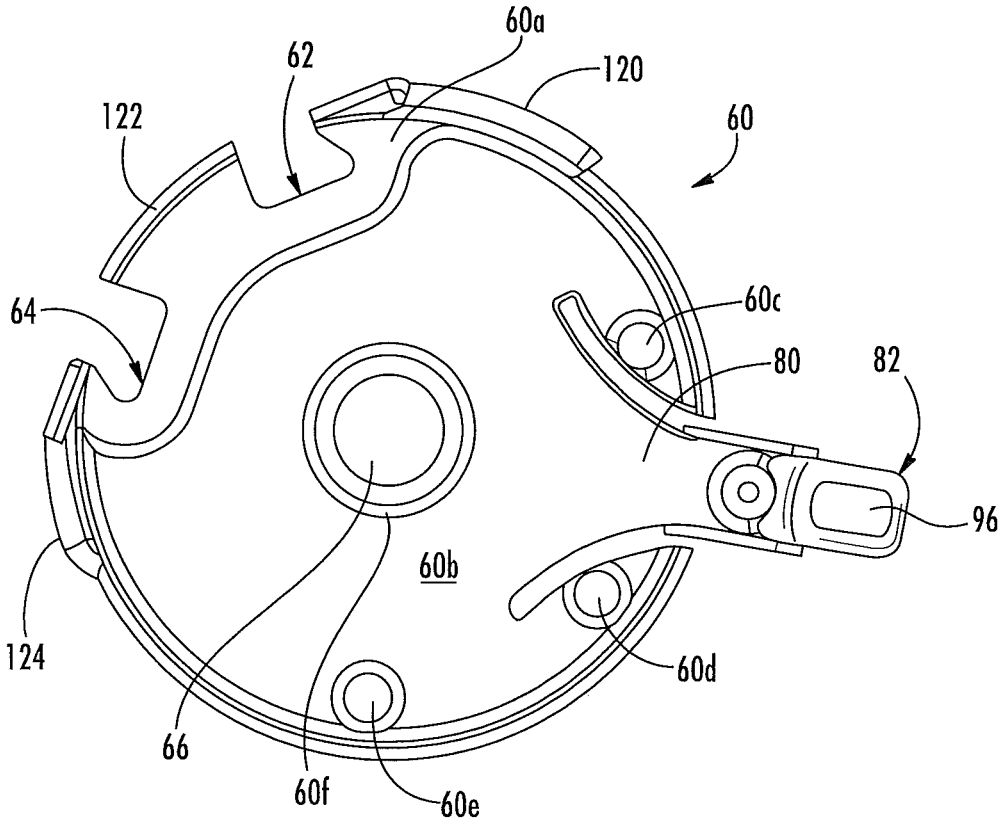

FIG. 9A illustrates a portion of housing member dissembled from the cutting tool shown in FIG. 1.

Figure 10:
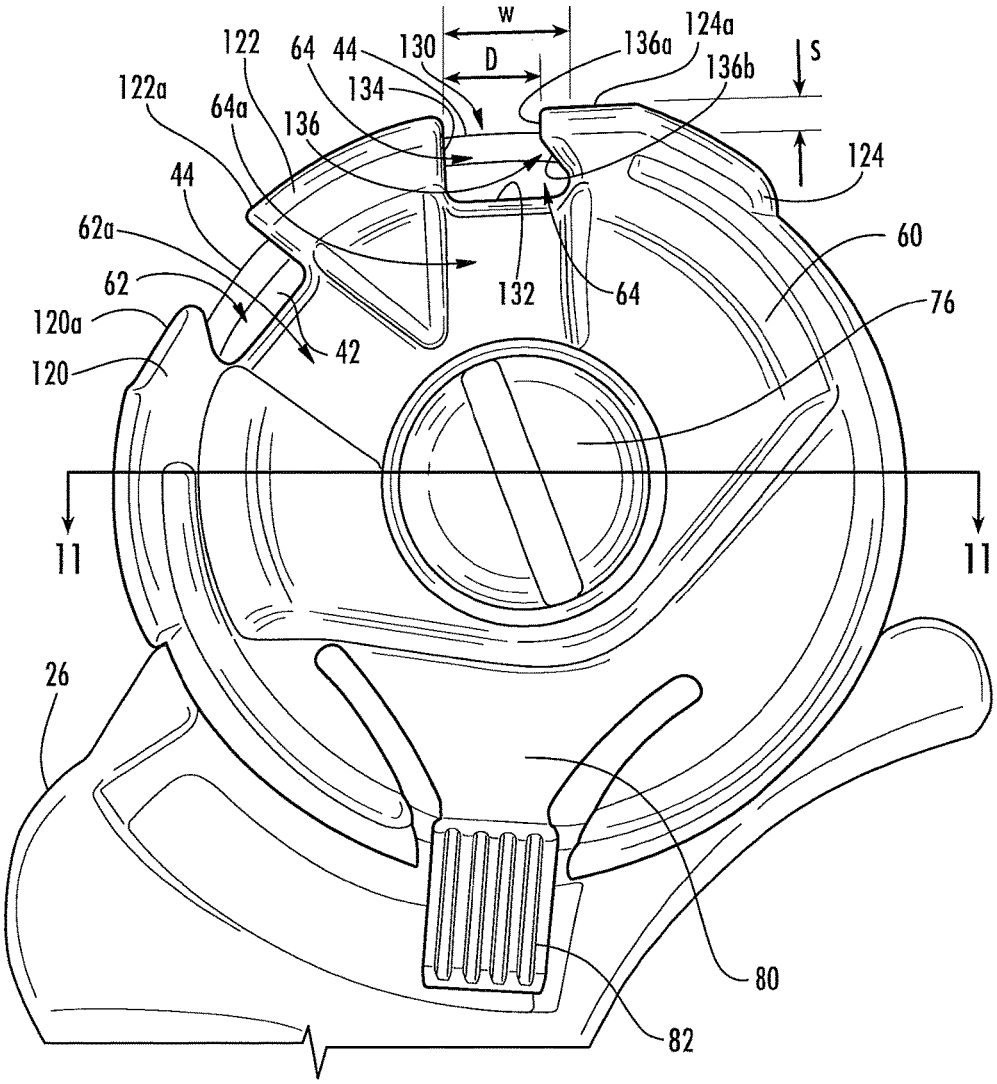

FIG. 10 illustrates a partial side elevational view of a cutting member dissembled from the cutting tool shown in FIG. 1.

Figure 11:
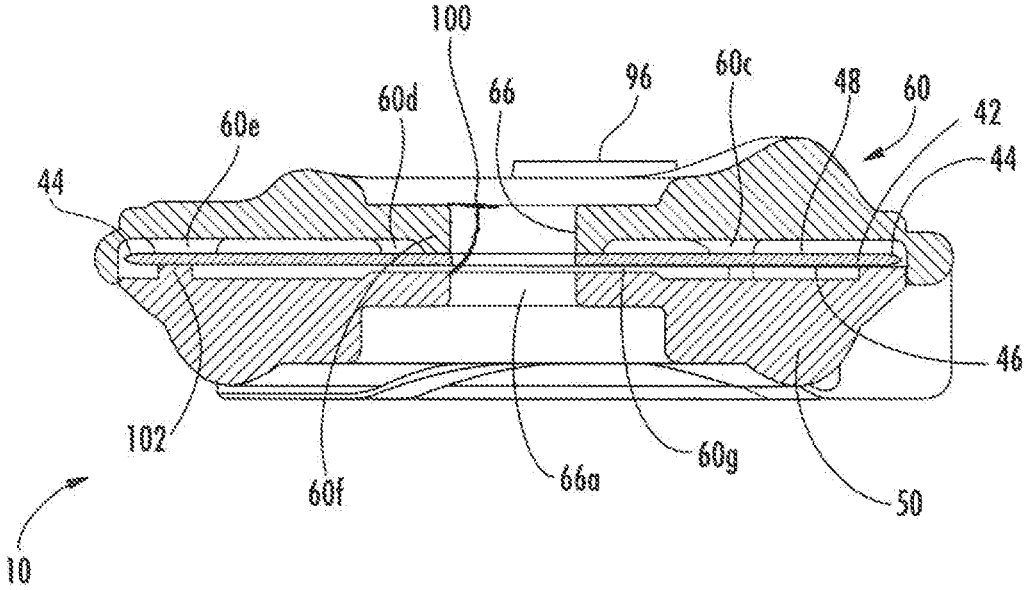

FIG. 11 is a sectional view taken along lines 11-11 of FIG. 10.

Figure 12:
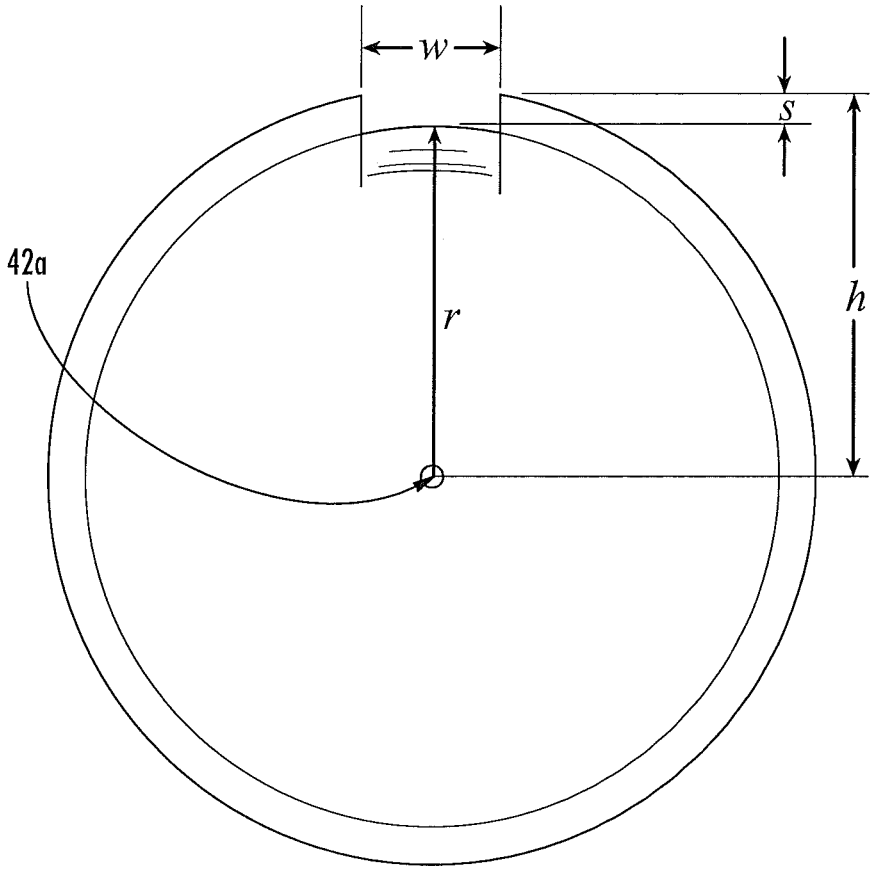

FIG. 12 is a schematic illustration of cutter configuration according to an example implementation of the present disclosure.

Figure 13:
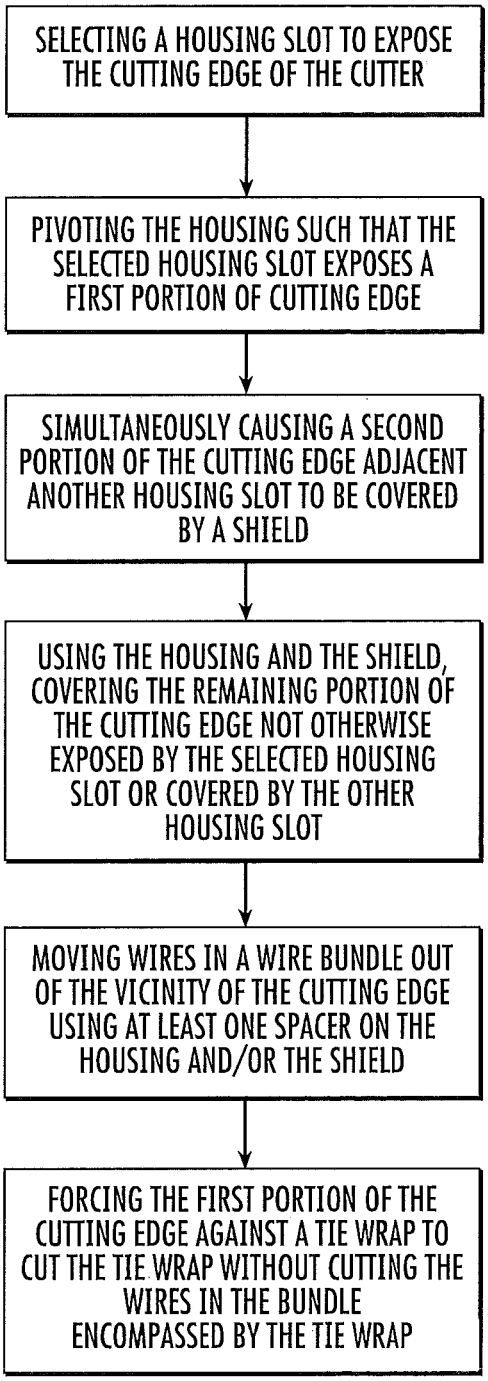

FIG. 13 is a flow diagram of implementation of a cutting tool according to one aspect of the present disclosure.

Figure 14:
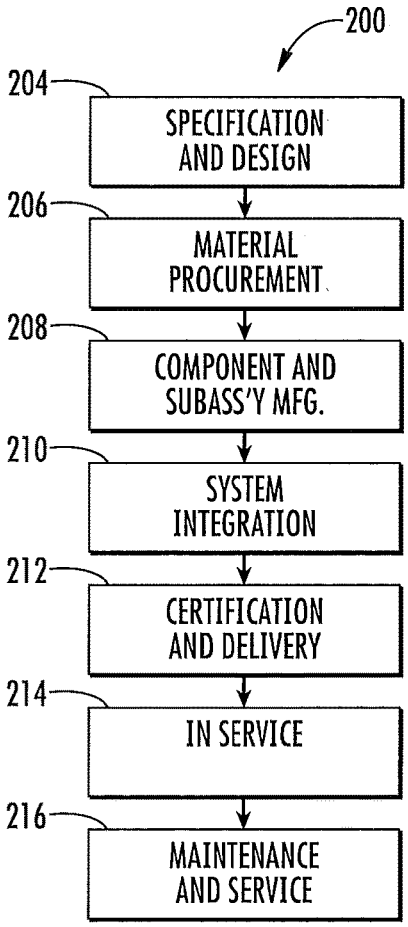

FIG. 14 is a flow diagram of aircraft production and service methodology.

Figure 15:
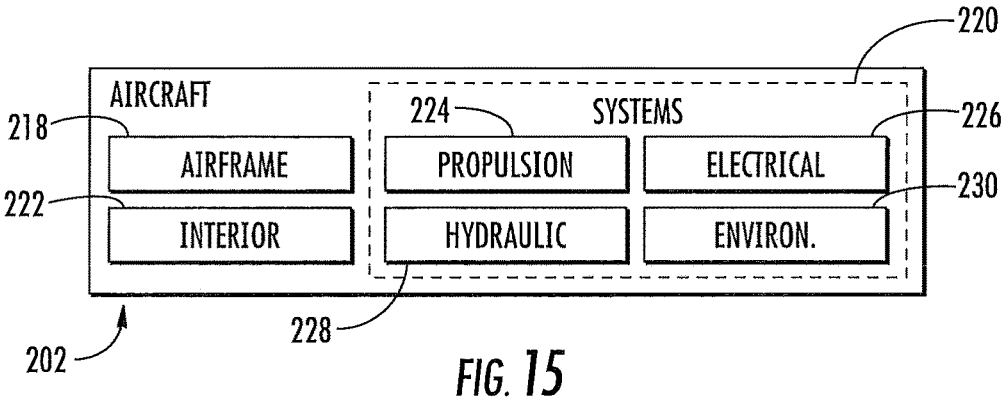

FIG. 15 is a block diagram of an aircraft.

Figure 16:
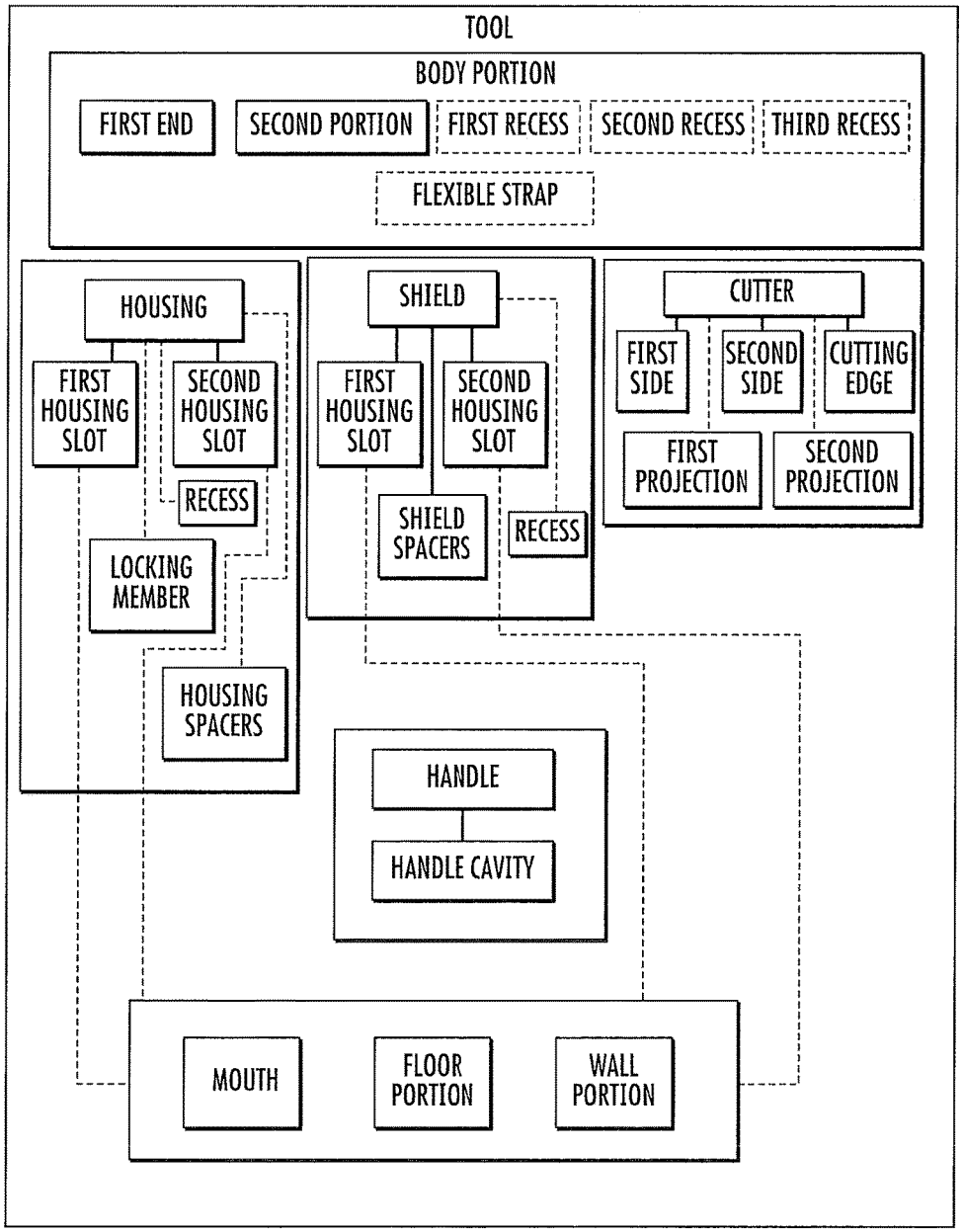

FIG. 16 is a functional diagram according to an example implementation of the present disclosure.

Although specific features of various implementations may be shown in some drawings and not in others, this is for convenience only. Any feature of any drawing may be referenced and/or claimed in combination with any feature of any other drawing.

DETAILED DESCRIPTION

Examples of the present disclosure will now be described more fully hereinafter with reference to the accompanying drawings, in which some, but not all examples of the disclosure are shown. Indeed, various exemplary aspects of the disclosure may be embodied in many different forms and should not be construed as limited to the examples set forth herein. Rather, these examples are provided so that this disclosure will be thorough and complete and will fully convey the scope of the disclosure to those skilled in the art. Like reference numerals refer to like elements throughout.

The implementations described herein relate to a resilient cutting process. Generally, the implementations relate to a cutting tool for cutting a fastener that contains an object, such as a bundle of wires. In one application, the cutting tool described herein is utilized to cut a tie wrap disposed about a bundle of wires. It should be understood that the implementations described herein are not limited to tie wraps, and further understood that the description and figures that utilize tie wraps and wires are exemplary only. The present invention is compatible with known tie wraps while providing a cutting process that is safe, (ergonomic) and non-damaging to wires contained by the fastener being cut. Accordingly, as used herein, "tie," "tie wrap," or "wire tie" as used herein includes wire ties, zip ties, straps, strings, cords, bands, chains, ropes, and the like, usable for gathering wires into a bundle.

Applicants hereby incorporate by reference the entirety of U.S. patent application Ser. No. 13/312,252, filed Dec. 6, 2011, and U.S. patent application Ser. No. 13/312,290, filed Dec. 6, 2011.

Referring to one example implementation of the present disclosure, FIG. 1 illustrates a cutting tool, generally designated as 10, which may be used to cut a fastener, such as, but not limited to, a tie wrap 12 (FIG. 4), extending about at least one wire 13, which may include a bundle 13*a* of wires 13, such as shown in FIGS. 4 and 6. In one example implementation, tie wrap 12 includes an elongated portion 14, having a securing mechanism 16 (FIG. 4). In an exemplary implementation, tool 10 at least partially cuts tie wrap 12 to facilitate removing tie wrap 12 from wire bundle 13*a*. More specifically, to facilitate its effectiveness, tool 10 cuts tie wrap 12 without damaging wires 13 within wire bundle 13*a* and without injury to the user.

As shown in FIGS. 1 and 2, tool 10 includes a handle, generally 20, defining a handle cavity 22. An elongated body portion or member, or arm, generally 26, which includes a handgrip portion 26*a*, is provided having a first portion 28 detachably connected to handle 20 for movement relative to handle 20. Arm 26 is movable between a retracted position, as shown in FIG. 6, and an extended position as shown in FIG. 1. In the retracted position, arm 26 is generally carried within handle cavity 22 (FIG. 3B), and in an extended position, arm 26 extends outwardly from handle 20 in a variety of angles (FIG. 2). For example, as shown in FIG. 1, arm 26 is extending at one angle with respect to handle 20, and in FIGS. 2 and 5, at another angle. Also, as shown in FIG. 6, arm 26 can be used for cutting a tie 12 while arm 26 is in the retracted position. As shown in FIGS. 3A and 3B, a proximal end of arm 26 may include an opening 34 for receiving an axle 32 provided in handle cavity 22. Opening 34 could include a slot 35 which allows arm 26 to slidingly engage flats 38 (FIG. 3B) of axle 32 until opening 34 receives axle 32 in a snap-fit relationship. Once axle 32 is received in opening 34, arm 26 is free to pivot about axle 32.

Arm 26 includes at the other, or distal, end thereof a second portion 40 (FIG. 3A) to which a generally disc-shaped blade, or cutter, 42 is attached for pivotal and/or rotational movement with respect to arm 26. As shown in FIG. 9, cutter 42 defines a generally arcuate or circumferentially extending cutting edge 44 and also includes a first side 46 (FIG. 7B) and a second side 48 (FIG. 9), generally opposite from first side 46. Although cutter 42 is shown as being disc-shaped in an example implementation, it is to be understood that cutter 42 could be other shapes including, but not limited to, a circle sector (not shown) which may resemble a slice of pie.

As shown in FIG. 7B, the second portion of arm 26 includes a shield, generally 50, that substantially covers first side 46 of cutter 42. Shield 50 defines at least one second portion, or shield, slot, and may include shield slots 52, 54 that communicate with a portion of cutting edge 44 of the cutter.

A housing, generally 60, is shown in FIG. 9 that may be fixedly and/or pivotally or rotationally connected to arm 26 and substantially covers second side 48 of cutter 42. Housing 60 may define at least one slot, such as first housing slot 62, and a second housing slot 64 that each extend generally radially outwardly from the central hole, or hole, 66 of housing 60. Central hole 66 includes an axle, generally 68, which could include a fastener or some other arrangement. In an exemplary implementation, axle 68 is received in shield central hole 66*a* and includes a headed fastener 70, an internally threaded shaft portion 72 into which a threaded shaft of portion 74 of a headed fastener 76 threadingly engages. A washer 78 can be provided between fastener 70 and shield 50.

Referring to FIG. 7B, defined in shield 50 are recesses 52*a* and 54*a* which communicate with and extend from slots 52, 54, respectively. Similarly referring to FIG. 7A, defined in housing 60 are recesses 62*a* and 64*a*, which communicate with and extend from slots 62, 64, respectively. Recesses 52*a*, 54*a*, 62*a*, and 64*a* each extend generally radially inwardly towards axle 68 (FIG. 9) from their respective slot (FIGS. 7A and 7B). Recesses 52*a*, 54*a*, 62*a*, and 64*a* each facilitate use of slots 52, 54, 62, and 64 in cutting a wire tie by being configured to provide a relief area into which a wire tie may move or flex as it is being cut, thereby reducing the likelihood of such wire tie from bridging across portions of shield 50 and/or housing 60 during a cutting operation, which could potentially hinder the cutting of such wire tie.

Housing 60 may be pivoted to a first position, as shown in FIG. 7B, wherein first slot 62 is generally in communication with shield slot 54, wherein a first portion of cutting edge 44 is exposed for use in cutting a tie wrap 12. Housing 60 may also be pivoted to a second position, as shown in FIG. 2, wherein first slot 62 FIG. 7A is generally out of communication with shield slot 54 FIG. 7B, and the first portion of the cutting edge 44 is substantially covered. Furthermore, housing 60 may be pivoted to a third position, wherein second slot 64 is generally in communication with shield slot 52, and a second portion of cutting edge 44 is exposed for use in cutting a tie wrap 12.

As shown in FIGS. 7A and 7B, arm 26 includes a locking member, generally 80, connected to and radially extending outwardly from housing 60. Locking member 80 includes an upper ridged portion 82 for engagement by one or more of the user's fingers to pivot locking member 80 and housing 60 between first, second, and third positions, wherein locking member 80 engages notches 84, 86, 88, respectively, as locking member 80 moves in channel 90. When locking member 80 is in first position notch 84, as shown in FIG. 1, housing 60 is in the first position, wherein first slot 62 of housing 60 is in communication with cutting edge 44 of cutter 42. Similarly, shield slot 54 is also in communication with cutting edge 44, wherein cutting edge 44 is exposed and available for cutting a fastener, such as shown in FIG. 4. In FIG. 2, locking member 80 is in a third position notch 88, wherein first slot 62 and second slot 64 of housing 60 are out of communication with either of shield slots 52, 54, and cutting edge 44 is blocked and secured against inadvertent cutting of ties or other items. Upon locking member 80 being in second position notch 86 FIG. 7B, second slot 64 of housing 60 is in communication with shield slot 52 such that cutting edge 44 is exposed for cutting using slots.

A downwardly extending locking tab 94 (FIG. 7B) is provided on the underside of locking member 80 and is engagable with notches 84, 86, and 88 in order to hold locking member 80 in the first, second, and third positions, respectively. Locking member 80 may be made of generally resilient construction such that when it is desired to pivot housing 60, locking member 80 is depressed such that a foot 96 on the end of locking tab 94 clears barriers 98*a* and 98*b* to move between notches 84, 86, and 88. Once the user releases locking member 80, foot 96 automatically seats within a notch 84, 86, or 88, provided foot 96 is aligned with one of such notches when locking member 80 is released.

As shown in FIG. 9, cutter 42 rotates about an axis of rotation 42*a* defined by axle 68 extending through the shield 50 and the housing 60, and includes a first boss portion, or projection, 100 on shield 50 which is generally coaxial with respect to axle 68 and which has a generally ring-shape of a first diameter. A ring-shaped or semi-circular-shaped projection, or portion, 102 is also provided on shield 50 and is generally coaxial with axle 68 and boss portion 100. Portion 102 is of a diameter greater than first ring-shaped portion 100, and in one example, portion 102 is of greater height than boss portion 100, as shown in FIG. 11. As shown in FIG. 9A, the underside of housing 60 includes a raised peripheral portion 60*a* extending outwardly from surface 60*b* and a plurality of nub, or post, portions 60*c*, 60*d*, and 60*e*, which contacts and support cutter 42. A boss portion, or projection, 60*f* generally coaxial with central hole 66 also extends outwardly from surface 60*b* and contacts and supports cutter 42 for rotation FIG. 9. Boss projection 60*f* is on the opposite side of cutter 42 with respect to portion 100 on shield 50, and in one example, a slight gap 60*g* FIG. 11 may be provided between cutter 42 and portion 100, in order to minimize binding of cutter 42 with respect to portions 100, 60*f* and to aid rotation of cutter 42 with respect to portions 60*f*, 100. First side 46 of cutter 42 bears against portions 100 and 102, and second side 48 of cutter 42 bears against 60*a* and portions 60*c*, 60*d*, 60*e*, and 60*f* in a manner which facilitates and which may cause automatic rotational movement of cutter 42 with respect to arm 26 during cutting of a wire tie in order to reduce overall blade wear. Rotational movement of cutter 42 may be desirable in order to allow fresh cutting edge 44 surfaces to be maintained for exposure via shield slots 52, 54, 62, and 64. Rotation of cutter 42 with respect to shield 50 and housing 60 can be done a number of ways, and may include, in one way, slightly engaging of a wire tie scrap (not shown) or tie wrap 12 with cutting edge 44 sufficient to cause cutter 42 to slightly bite into such wire tie, and then carefully rotating arm 26 (while cutter 42 is held generally static with respect to the wire tie). This can allow for cutter 42 to be rotated and a fresh portion of cutting edge 44 presented to slots 52, 54, 62, and 64.

As shown in FIG. 7B, shield 50 includes three spacer portions, 110, 112, 114, respectively, which extend generally radially with respect to central hole 66*a* and which are generally wedged-shaped. Additionally, as shown in FIG. 7A, housing 60 includes similar spacers, 120, 122, 124, which also extend radially outwardly from central hole 66*a*. Slot 62 is between spacers 120 and 122, and slot 64 is between spacers 122 and 124. As shown in FIG. 10, spacers, 120, 122, 124 each include a respective leading edge, 120*a*, 122*a*, and 124*a* thereon. Shield slot 52 FIG. 7B is between spacers 110 and 112, and shield slot 54 is between spacers 112 and 114. Shield spacers 110, 112, and 114 and housing spacers 120, 122, and 124 each (when cutter 42 is used to cut a tie wrap 12) push wires 13 of a wire bundle 13*a* out of the way as cutting edge 44 is advanced into a tie wrap 12 for cutting tie wrap 12. In effect, means for moving a wire out of the vicinity of an exposed portion of the cutting edge 44 prior to use of the exposed portion of the cutting edge 44 in cutting a tie wrap tie wrap 12 may include, in one example, shield spacers 110, 112, and 114 and/or the housing spacers, 120, 122, 124, which maintain wires 13 in bundle 13*a* at a generally predetermined setback distance away from cutting edge 44 during use, such distance being indicated by S in FIG. 10 in relation to slot 64.

As shown in FIGS. 10 and 12, in one example implementation, the setback distance S between cutting edge 44 and a respective leading edge 120*a*, 122*a*, and 124*a* of spacers 120, 122, and 124, may be an associated predetermined distance calculated and/or approximated by the following formula:

$$S = 0.035'' + r - \sqrt{r^2 - \left(\frac{w^2}{4}\right)}$$

As shown in FIG. 12, h is the distance from the axis of rotation 42*a* to a leading edge. In such formula, w is the width of slot 64, and r is the radius of cutter 42, i.e., the distance from the axis of rotation of cutter 42 to cutting edge 44. By way of a non-limiting example use of the formula, for a cutter having a radius r of approximately 0.551 inches and a slot width w of approximately 0.15 inches, the setback S would be approximately 0.040 inches. It is to be understood, however, that setback S could be a variety of different dimensions, depending on the particular application, desired results, etc., and is not to be construed as being limited to the result reached using the formula described above. The spacers contact, move and maintain wire 13 away from cutter 42 during cutting procedures. In an exemplary implementation, the spacers are sized to extend beyond the exposed portion of cutting edge 44. In an exemplary implementation, the spacers are wedge-shaped. In alternative implementations, spacers can have any other shapes such as, but not limited to, a round shapes. The length of a spacer is sized to accommodate for the thickness a tie wrap 12. The spacers create a protection zone around the cutter 42.

An example implementation of the design of slots 52, 54, 62, and 64 is shown in FIGS. 7B and 10. Such slots each include a configuration, shown by example in connection with slot 64, such that the opening, or mouth, 130 of each slot is of a width w, which is less than the width of the base, or floor, 132 of slot 64, such width being identified as D. Extending from adjacent mouth 130 towards floor 132 is a first sidewall 134, and generally opposite first sidewall 134 is a second sidewall, generally 136, having a first wall portion 136*a*, which is generally parallel to sidewall 134, and a second wall portion 136*b* which is at a generally acute angle with respect to floor 132, as second wall portion 136*b* extends from first wall portion 136*a* to proximate floor 132. This asymmetric configuration with respect to mouth 130 of each of slots 52, 54, 62, and 64, i.e., wherein sloth width w is narrower than the width D of floor 132, allows for the cutting of larger ties, i.e., ties being of greater width than w of mouth 130, without increasing the length of cutting edge 44 which is exposed, thereby minimizing exposure of cutting edge 44. Mouth 130 can approach larger ties at an angle, such that one edge of the tie may enter mouth 130 and pass under wall portion 136*a* towards the wider D width portion of a slot, in a hook and roll type motion. In other words, in an exemplary implementation, arm 26 may be moved in a motion generally parallel to the wire or wires 13 and the acute angle wall portion 136*b* to start cutting a tie wrap from its side. The cut portion of the tie wrap can then be slid into the greater second width of the slot proximate floor 132, to thereby potentially allow tie wraps wider than mouth 130 to be cut. This, accordingly, can reduce the likelihood of damaging of wires in bundle 13*a* and also the risk of the user being cut or some other item being inadvertently cut or damaged.

As shown in FIG. 6, tool 10 may be provided with an elastic and/or adjustable strap, generally 140, which extends outwardly from slots 142 from one or both sides of handle 20. As shown in FIG. 6, a user, generally U, could insert his or her thumb or fingers through strap 140 on one or both sides of handle 20 in order to allow gain better purchase of tool 10 in his or her hand. Also, strap 140, by allowing for improved gripping of tool 10, may enhance the ability of tool 10 to be operated by the user using only one hand, as shown in FIG. 6. Strap 140, in an example implementation, can include one or more buckles 144 to allow for adjustment of the strap to a user's personal preference. However, such buckles 144 or other adjustment devices (not shown) may be used or not used as desired.

As shown in FIGS. 8A and 8B, in one example implementation, tool 10 includes a second body portion or member, or arm, generally 150, which may be attached to handle 20. Arm 150 is similar to arm 26, and the same referenced numerals are used in connection with arm 150 to indicate identical components previously described. Arm 150 is movable from a retracted position within handle cavity 22, as shown in FIG. 6, to a variety of extended positions, such as shown in FIGS. 1, 2, 5, and 6. Arm 150 may include a tab 150*a* having a recess 150*b*, notch, or other profile that assists a user in grasping and gaining purchase on tab 150*a* to withdrawn arm 150 from a retracted position within handle cavity 22. Arm 150 includes a shield 152 which defines a slot 154 of generally asymmetric configuration such as discussed above with respect to slots 52, 54, 62, and 64. Arm 150, as shown in FIGS. 8A and 8B may include opening 160 for receipt of axle 74. A slot 162 leading to opening 160 for allowing arm 150 to be readily inserted onto axle 32 of handle 20, when slot 162 is aligned with flats 38 of axle 32 in a snap-fit relationship.

Arm 150 is provided at a distal end thereof with a cutter 170 having a first side which is substantially covered by shield 152, and a pivotable housing, generally 174, having a slot 176 of asymmetric construction such as discussed above. Housing 174 also includes a locking member 178 for engagement by a user's thumb and/or fingers. Locking member 178 operates in similar manner as locking member 80 to selectively lock housing 174 in a safe or cutting position through engagement of locking member 178 with notches 180. Locking member 178 also includes a downwardly extending projection (not shown) engagable with notches 180 (FIG. 5) such that housing 174 can be pivoted from a position where housing slot 176 is in communication with both the cutting edge 44 of cutter 170 and with slot 154 of shield 152 for allowing cutting edge 44 to be exposed for cutting a wire tie or other item. Housing 174 may also be rotated to a second position, wherein slots 154, 176, and cutting edge 44 are no longer in simultaneous communication with one another, thereby rendering cutting edge relatively "safe" against inadvertent cutting of something or someone. If desired, arm 26 and/or arm 150 may be detached from handle 20 and used as individual tools, separate and apart from handle 20.

In one exemplary implementation, cutter 42 is a circular-shaped blade having a diameter of between about 10 mm (0.40 in.) to about 40 mm (1.6 in.). In an exemplary implementation, blade 32 has a diameter of about 28 mm. In another exemplary implementation, cutter 42 has a diameter of about 40 mm. Cutter 42 is variably selected to have a size that accommodates at least partially cutting a plurality of different sized elongated portions 14. Any size cutter 42 may be used that enables tool 10 to function as described herein.

In an exemplary implementation, in using tool 10 to cut an arm 26 on a wire bundle, generally, a user may select a housing slot 62, 64 to expose the cutting edge 44 of the cutter, and then pivot the housing such that the selected housing slot exposes a first portion of the cutting edge 44. Simultaneously, a second portion of the cutting edge adjacent another housing slot 62 or 64 pivot housing is covered by the shield 50. The remaining portion of cutting edge 44 not exposed by the selected housing slot is covered by the housing 60 and the shield 50. The wire is moved out of the vicinity of the cutting edge using at least one spacer on the housing and/or the shield, and the first position of the cutting edge 44 exposed by the selected housing slot is forced against the elongated portion 14 to cut it without cutting a wire or wire bundle encompassed by the elongated portion.

More specifically, an exemplary method may include a user grasping handle 20 to operate tool 10 to facilitate cutting an elongated portion 14. The user may select desired cutter carried by arm 26 or arm 150, depending on the application and/or circumstances. For example, if the user chooses arm 26, the user may select which shield slot 52, 54 to use for cutting an elongated portion 14. Should the user choose shield slot 54, cutting edge 44 will need to be exposed at slot 54. The user may thus rotate housing 60 to the first position (wherein foot 96 of locking member 80 engages notch 84) to expose cutting edge 44 at slot 54 by aligning slot 54 with slot 62. The tool may be manipulated by the user to position the elongated portion 14 of a tie wrap 12 within the aligned slots 54, 62 and against cutting edge 44. Because the spacers 110, 112, and 120, 122, extend beyond shield 50 and housing 60, respectively, as slots 54, 62 are positioned about elongated portion 14, the spacers contact and displaces wires in bundle 13*a* out and away from the area of elongated portion 14 which is to be cut and, accordingly, away from cutting edge 44, such that cutting edge 44 does not contact such displaced wires. At this point, tool 10 may be generally parallel to the wires in bundle 13*a* (FIG. 6). Alternately, the user could use shield slot 52 if desired, in which case, the user would align slots 52, 64 and use the portion of cutting edge 44 thereat to cut elongated portion 14. In such instance, spacers 112, 114, and 122, 124 contact and displace wires in bundle 13*a* out and away from elongated portion 14 during cutting of an elongated portion 14.

As shown in FIG. 13, another example method according to an implementation of the present disclosure may include: selecting a housing slot to expose the cutting edge of the cutter; pivoting the housing 60 such that the selected housing slot exposes a first portion of cutting edge 44; simultaneously causing a second portion of the cutting edge 44 adjacent another housing slot to be covered by shield 50; using the housing 60 and the shield 50, covering the remaining portion of the cutting edge not otherwise exposed by the selected housing slot or covered by the other housing slot; moving wires in a wire bundle 13*a* out of the vicinity of the cutting edge 44 using at least one spacer on the housing and/or the shield; and forcing the first portion of the cutting edge 44 against a tie wrap 12 to cut the tie wrap without cutting the wires in the wire bundle 13*a* encompassed by the tie wrap 12.

Given the variety of angles that arms 26 and 150 may be placed with respect to handle 20, and the ability of the tool of arm 26 and the tool of arm 150 to be detached and used separately from handle 20, wire ties in tight and/or hard to reach places may be more readily accessed and cut by tool 10.

It is to be understood that use of the arm 150 tool would be similar to that discussed above regarding the arm 26 tool and that alternately, the user could detach arm 26 and/or arm 150 from handle 20 and use arm 26 and/or arm 150 in a similar manner.

Referring more particularly to FIGS. 14 and 15, embodiments of the disclosure may also be described in the context of an aircraft manufacturing and service method 200 as shown in FIG. 14 and an aircraft 202 as shown in FIG. 15. During pre-production, exemplary method 200 may include specification and design 204 of the aircraft 202 and material procurement 206. During production, component and sub-assembly manufacturing 208 and system integration 210 of the aircraft 202 takes place. Thereafter, the aircraft 202 may go through certification and delivery 212 in order to be placed in service 214. While in service by a customer, the aircraft 202 is scheduled for routine maintenance and service 216 (which may also include modification, reconfiguration, refurbishment, and so on).

Each of the processes of method 200 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 13, the aircraft 202 produced by exemplary method 200 may include an airframe 218 with a plurality of systems 220 and an interior 222. Examples of high-level systems 220 include one or more of a propulsion system 224, an electrical system 226, a hydraulic system 228, and an environmental system 230. Any number of other systems may be included. Although an aerospace example is shown, the principles of the invention may be applied to other industries, such as the automotive industry.

Apparatus and methods embodied herein may be employed during any one or more of the stages of the production and service method 200. For example, components or subassemblies corresponding to production process 208 may be fabricated or manufactured in a manner similar to components or subassemblies produced while the aircraft 202 is in service. Also, one or more apparatus embodiments, method embodiments, or a combination thereof may be utilized during the production stages 208 and 210, for example, by substantially expediting assembly of or reducing the cost of an aircraft 202. Similarly, one or more of apparatus embodiments, method embodiments, or a combination thereof may be utilized while the aircraft 202 is in service, for example and without limitation, to maintenance and service 216.

FIG. 16 illustrates functional aspects of an example implementation of the present disclosure.

The subject matter described herein relates generally to cutting tools and, more particularly, to cutting tools for use in cutting tie wraps to free wires bound by the tie wraps. The tool includes slots that are selectively positionable to facilitate aligning a blade to control the depth of the blade into the tie wrap during cutting procedures. The tool also includes spacers that prevent inadvertent blade contact with the wires bound by the tie wrap. As such, use of the tool described herein facilitates increasing the reliability and/or efficiency of cutting a tie wrap without damaging a wire and without injuring the user.

Exemplary implementations of systems and methods for using a cutting tool are described above in detail. The systems and methods are not limited to the specific implementations described herein, but rather, components of systems and/or steps of the method may be utilized independently and separately from other components and/or steps described herein. The disclosed dimensional ranges include all sub ranges there between. Further, tool may be fabricated from any material that enables tool to function as described herein. Each component and each method step may also be used in combination with other components and/or method steps. Although specific features of various implementations may be shown in some drawings and not in others, this is for convenience only. Any feature of a drawing may be referenced and/or claimed in combination with any feature of any other drawing.

Many modifications and other exemplary aspects of the disclosure set forth herein will come to mind to one skilled in the art to which this disclosure pertains, having the benefit of the teachings presented in the foregoing descriptions and the associated drawings. Therefore, it is to be understood that the disclosure is not to be limited to the specific examples disclosed and that modifications and other exemplary aspects of the disclosure are intended to be included within the scope of the appended claims. Moreover, although the foregoing descriptions and the associated drawings illustrate examples in the context of certain example combinations of elements and/or functions, it should be appreciated that different combinations of elements and/or functions may be provided by alternative examples without departing from the scope of the appended claims. For instance, different combinations of elements and/or functions than those explicitly described above are also contemplated as may be set forth in the appended claims. Although specific terms are employed herein, they are used in a generic and descriptive sense only and not for purposes of limitation.

What is claimed is:

1. A method of operating a cutting tool for cutting a tie wrap bound about at least one wire, the tie wrap having a side portion, the method comprising:

providing a body member of the cutting tool having a cutter and a shield, the cutter being rotatably connected to the shield of the body member, the shield substantially covering a first side of the cutter, and the shield defining at least one shield slot that communicates with a portion of a generally arcuate cutting edge of the cutter;

providing a housing of the cutting tool, pivotally connected to the shield of the body member, that covers a substantial portion of a second side of the cutter, and that defines at least one housing slot that communicates with the cutting edge of the cutter;

moving the housing to a first position, wherein the at least one housing slot is generally out of communication with the at least one shield slot and the portion of the cutting edge is substantially covered;

moving the housing to a second position, wherein the at least one housing slot is generally in communication with the at least one shield slot and the portion of the cutting edge is exposed for use in cutting the tie wrap;

using the shield and the housing to move the at least one wire out of a vicinity of the cutting edge; and forcing the portion of the cutting edge against the tie wrap to at least partially cut the tie wrap without cutting the at least one wire.

2. The method according to claim 1, further comprising:

providing the at least one housing slot or the at least one shield slot with a mouth, a floor portion, and a wall portion, the floor portion being generally opposite the mouth, the mouth being of a first width and the floor portion being of a second width, the second width being greater than the first width, and the wall portion extending at a generally acute angle with respect to the floor portion from proximate the mouth to proximate the floor portion;

moving the body member using a motion parallel to the at least one wire;

engaging the tie wrap with the wall portion;

cutting the side portion of the tie wrap with the portion of the cutting edge; and sliding the cut portion of the side portion of the tie wrap toward the floor portion.

3. The method according to claim 1, wherein a minimum gap between the at least one wire and the cutting edge is a predetermined setback distance.

4. The method according to claim 1, wherein a minimum gap between a peripheral edge of the housing and the cutting edge is a predetermined setback distance, S, wherein S in inches is calculated by the following formula:

$$S = 0.035'' + r - \sqrt{r^2 - \left(\frac{w^2}{4}\right)}$$

wherein r is a distance in inches from an axis of rotation of the cutter to the cutting edge, and wherein w is a width in inches of the at least one housing slot or the at least one shield slot.

5. The method according to claim 1, wherein the using of the shield and the housing to move the at least one wire out of the vicinity of the cutting edge uses one or more spacers of the shield.

6. The method according to claim 1, wherein the using of the shield and the housing to move the at least one wire out of the vicinity of the cutting edge uses one or more spacers of the housing.

7. The method according to claim 1, wherein the using of the shield and the housing to move the at least one wire out of the vicinity of the cutting edge uses one or more spacers of the shield and one or more spacers of the housing.

8. The method according to claim 1, wherein a width of a mouth of the at least one shield slot is smaller than a width of a floor of the at least one shield slot.

9. The method according to claim 1, wherein a width of a mouth of the at least one housing slot is smaller than a width of a floor of the at least one housing slot.

10. A method of operating a cutting tool for cutting a tie wrap on a plurality of wires, the method comprising:

providing a body member of the cutting tool, the body member having a cutter, a shield, and a housing, the cutter having a cutting edge, the cutter being rotatably connected to the shield of the body member, the shield substantially covering a first side of the cutter, the shield defining at least one shield slot that communicates with a portion of the cutting edge of the cutter, the housing being pivotally connected to the shield of the body member, the housing substantially covering a second side of the cutter, and the housing defining a first housing slot and a second housing slot that each selectively exposes the cutting edge with the at least one shield slot;

selecting one of the first housing slot and the second housing slot to expose a first portion of the cutting edge with the at least one shield slot;

pivoting the housing to a first position, such that a selected one of the first housing slot and the second housing slot exposes the first portion of the cutting edge, with the at least one shield slot, while simultaneously causing a second portion of the cutting edge, adjacent the non-selected one of the first housing slot and the second housing slot, to be substantially covered by the shield;

aligning the body member parallel to the wires;

using the housing to move the wires out of a vicinity of the cutting edge; and forcing the first portion of the cutting edge against the tie wrap to at least partially cut the tie wrap without cutting the wires.

11. The method according to claim 10, further comprising:

providing the first housing slot or the second housing slot with a mouth, a floor portion, and a wall portion, the floor portion being generally opposite the mouth, the mouth being of a first width and the floor portion being of a second width, the second width being greater than the first width, and the wall portion extending at a generally acute angle with respect to the floor portion from proximate the mouth to proximate the floor portion;

moving the body member using a motion parallel to the wires;

engaging the tie wrap with the wall portion;

cutting a side portion of the tie wrap with the first portion of the cutting edge; and sliding the cut portion of the side portion of the tie wrap toward the floor portion.

12. The method according to claim 10, wherein the housing is configured to pivot to a second position, such that the selected one of the first housing slot and the second housing slot is generally out of communication with the second portion of the cutting edge, and the first portion of the cutting edge is substantially covered by the housing, by the shield, or by the housing and the shield.

13. The method according to claim 10, wherein a minimum gap between the wires and the cutting edge is a predetermined setback distance.

14. The method according to claim 10, wherein a minimum gap between a peripheral edge of the housing and the cutting edge is a predetermined setback distance, S, wherein S in inches is calculated by the following formula:

$$S = 0.035'' + r - \sqrt{r^2 - \left(\frac{w^2}{4}\right)}$$

wherein r is a distance in inches from an axis of rotation of the cutter to the cutting edge, and wherein w is a width in inches of the selected one of the first housing slot and the second housing slot.

15. A method of operating a cutting tool for cutting a tie wrap on a plurality of wires, the method comprising:

providing a body member of the cutting tool, the body member having a cutter, a shield, and a housing, the cutter having a cutting edge, the cutter being rotatably connected to the shield of the body member, the shield substantially covering a first side of the cutter, the shield defining at least one shield slot that communicates with a portion of the cutting edge of the cutter, the housing being pivotally connected to the shield of the body member, the housing substantially covering a second side of the cutter, and the housing defining a first housing slot and a second housing slot that each selectively exposes the cutting edge with the at least one shield slot;

selecting one of the first housing slot and the second housing slot to expose a first portion of the cutting edge with the at least one shield slot;

pivoting the housing to a first position, such that a selected one of the first housing slot and the second housing slot exposes the first portion of the cutting edge, with the at least one shield slot, while simultaneously causing a second portion of the cutting edge, adjacent the non-selected one of the first housing slot and the second housing slot, to be substantially covered by the shield;

aligning the cutting edge perpendicular to the tie wrap;

using the housing to move the wires out of a vicinity of the cutting edge; and forcing the first portion of the cutting edge against the tie wrap to at least partially cut the tie wrap without cutting the wires.

16. The method according to claim 15, further comprising:

providing the first housing slot or the second housing slot with a mouth, a floor portion, and a wall portion, the floor portion being generally opposite the mouth, the mouth being of a first width and the floor portion being of a second width, the second width being greater than the first width, and the wall portion extending at a generally acute angle with respect to the floor portion from proximate the mouth to proximate the floor portion;

moving the body member using a motion parallel to the wires;

engaging the tie wrap with the wall portion;

cutting a side portion of the tie wrap with the first portion of the cutting edge; and sliding the cut portion of the side portion of the tie wrap toward the floor portion.

17. The method according to claim 15, wherein the housing is configured to pivot to a second position, such that the selected one of the first housing slot and the second housing slot is generally out of communication with the second portion of the cutting edge, and the first portion of the cutting edge is substantially covered by the housing, by the shield, or by the housing and the shield.

18. The method according to claim 15, wherein a minimum gap between the wires and the cutting edge is a predetermined setback distance.

19. The method according to claim 15, wherein a minimum gap between a peripheral edge of the housing and the cutting edge is a predetermined setback distance, S, wherein S in inches is calculated by the following formula:

$$S = 0.035'' + r - \sqrt{r^2 - \left(\frac{w^2}{4}\right)}$$

wherein r is a distance in inches from an axis of rotation of the cutter to the cutting edge, and wherein w is a width in inches of the selected one of the first housing slot and the second housing slot.

20. The method according to claim 15, further comprising:

when aligning the cutting edge perpendicular to the tie wrap, also aligning the body member parallel to the wires.

* * * * *